United States Patent [19]

Okamoto et al.

[11] Patent Number: 4,557,972

[45] Date of Patent: Dec. 10, 1985

[54] ULTRAFINE SHEATH-CORE COMPOSITE FIBERS AND COMPOSITE SHEETS MADE THEREOF

[75] Inventors: Miyoshi Okamoto, Takatsuki; Hiromichi Iijima, Otsu; Akito Miyoshi, Kusatsu, all of Japan

[73] Assignee: Toray Industries, Inc., Tokyo, Japan

[21] Appl. No.: 678,386

[22] Filed: Dec. 6, 1984

Related U.S. Application Data

[63] Continuation of Ser. No. 347,623, Feb. 10, 1982, abandoned, which is a continuation-in-part of Ser. No. 338,978, Jan. 12, 1982, abandoned.

[51] Int. Cl.[4] ..... D02G 3/00; B29F 3/10

[52] U.S. Cl. ..... 428/373; 428/397; 428/903; 264/171

[58] Field of Search ..... 428/373, 369, 374, 397, 428/370, 904, 903; 264/211, 171, 147

[56] References Cited

U.S. PATENT DOCUMENTS

| | | | |
|---|---|---|---|
| 4,059,949 | 11/1977 | Lee | 428/373 |
| 4,073,988 | 2/1978 | Nishida et al. | 428/904 |
| 4,381,335 | 4/1983 | Okamoto | 428/373 |

FOREIGN PATENT DOCUMENTS

| | | |
|---|---|---|
| 46-03814 | 2/1971 | Japan . |
| 46-27776 | 8/1971 | Japan . |
| 1149270 | 4/1969 | United Kingdom . |
| 1326244 | 8/1973 | United Kingdom . |

*Primary Examiner*—George F. Lesmes
*Assistant Examiner*—Beverly K. Johnson
*Attorney, Agent, or Firm*—Austin R. Miller

[57] ABSTRACT

Improved ultrafine sheath-core composite fibers and composite sheets composed of these fibers are disclosed. The composite fibers have a fineness in the range of 0.0001 to 0.5 denier and a core/sheath weight ratio in the range of 10/90 to 70/30. The core has a very high intrinsic viscosity within a specific range and is located at the center of the sheath. The sheath is composed of a polyester copolymerized with 1.5 to 8 mole % of 5-sodium (or lithium or potassium) sulfoisophthalate, based on the total acid component, of 5-sodium (or lithium or potassium) sulfoisophthalate and having a thickness of 0.04 to 2 microns. The composite fibers have a high strength and are dyeable with a cationic dye. When the composite fibers are combined with an elastic material such as polyurethane, suede-like artificial leathers having excellent softness, touch, feel and color can be obtained.

4 Claims, 7 Drawing Figures

ULTRAFINE SHEATH-CORE COMPOSITE FIBERS AND COMPOSITE SHEETS MADE THEREOF

This is a continuation of application Ser. No. 347,623, now abandoned, which was filed on Feb. 10, 1982 and which in turn is a continuation-in-part of application Ser. No. 338,978, now abandoned, which was filed on Jan. 12, 1982.

BACKGROUND OF THE INVENTION

This is a continuation-in-part of copending application Ser. No. 338,978 entitled Ultrafine Sheath-Core Composite Fibers and Composite Sheets Made Thereof, which was filed on Jan. 12, 1982, by the same applicants.

Ultrafine fibers and artificial leathers prepared by using ultrafine fibers are known. In the case of artificial leathers made of ultrafine polyamide fibers, such as nylon 6 raised fibers are readily entangled and a beautiful appearance can not easily be obtained. Polyacrylonitrile ultrafine fibers are dissolved in a polyurethane (referred to PU hereinafter) solvent or deteriorated therein. In general, polyester ultrafine fibers such as polyethylene terephthalate (referred to PET hereinafter) ultrafine fibers give a harder or stiffer suede-like artificial leather because of the relation between the PU binder and the fibers than an artificial leather made of nylon 6 or nylon 66 ultrafine fibers. Moreover artificial leathers made of polyester ultrafine fibers such as PET are defective in that the fibers cannot be dyed with a cationic dye and a brilliant dyed color cannot be obtained and that the raised fibers are not soft enough. Moreover, the polyester ultrafine fibers can not easily be dyed a deep color with disperse dye while maintaining color fastness and hence, the dyeing cost is increased.

Moreover, in general, one must use a much greater amount of disperse dye than cationic dye.

A cationic dyeable polyester ultrafine fiber is very weak in strength and does not give strong artificial suede. A cationic dyeable polyester which is copolymerized sufficiently to be dyed a deep color does not have enough fiber strength even if the degree of polymerization is increased to the limit of spinnability.

SUMMARY OF THE INVENTION

It has been desired to develop ultrafine fibers capable of providing a strong suede-like artificial leather or woven or knitted fabric, capable of being dyed with a cationic dye and hence, being brilliantly and deeply colored, at reduced costs, and also capable of being formed into flexible products excellent in the softness of touch.

As a cationic dyeable polyester, a copolymer comprising 5-sodium (or lithium or potassium) sulfoisophthalate (referred to 5-SS hereinafter) can be mentioned. When an artificial leather was prepared according to known means from these ultrafine fibers which were prepared from this copolymer, it was found that an artificial leather having a sufficient strength could not be obtained because the fibers are too weak. If the ratio of copolymer was reduced, a deep or brilliant color could not be obtained.

Moreover, it was found that even if the degree of the polymerization was increased to a critical level allowing production of ultrafine fibers, it was impossible to impart sufficient strength to the resulting fibers.

Furthermore, it was found that when a cationic dye dyeable or acid dye dyeable polyamide was used, raised fibers were readily entangled by rubbing or chafing in practical use and the dye fastness was poor, and an intended product could not easily be obtained.

In short, ultrafine fibers having a thickness of 0.0001 to 0.5 denier and being capable of satisfying the above-mentioned objects were not available prior to the present invention.

To accomplish the object of the present invention the inventors first tried an ultrafine fiber comprising a core composed of a cationic dyeable polyester and a sheath composed of PET as reinforcing (covering) component. But the dye did not substantially penetrate the fiber. Because the inventors thought that the cationic dye did not diffuse through the PET sheath, blended polymers comprising PET and a small amount of core component (5-SS copolymerized PET) were used as the sheath component to improve the diffusion of cationic dye into the core component, but the core could not be dyed substantially.

Therefore as extraordinary means, ultrafine composite fibers comprising a sheath composed of a cationic dye dyeable polyester and a core composed of reinforcing component were considered. However, many persons skilled in the art denied the above consideration, reasoning that in such composite fibers, if there is present a weak component on the periphery, once the outer weak component is broken or cracked, the crack or break is easily propagated from the weak component to the core component and sufficient strength cannot be obtained.

In the case of an ordinary denier polyester comprising a sufficient amount of copolymerized 5-SS units, a so-called "frosting" phenomenon, that is, whitening of fiber surfaces caused by fibrillation of the fibers, readily takes place, and therefore, it has been stated that it is difficult to obtain a satisfactory product from such polyester.

The inventors of the present invention have discovered a common domain which provides improved fiber strength and deep and brilliant color using cationic dyes by means of following features; (a) a polyester type sheath-core ultrafine composite fiber wherein (b) fineness is 0.5–0.0001 denier (c) the core component is located substantially at the center of the sheath component (d) the specified core component is substantially composed of PET having a surprisingly high IV-value of 0.75–1.2 or polybutylene terephthalate (referred to PBT hereinafter) having a surprisingly high IV-value of 0.85–2.5 and the sheath component is substantially composed of a specified polyester copolymerized with 5-SS component, (e) the core/sheath weight ratio is in the narrow range of from 10/90 to 70/30 and the thickness of the sheath is extremely limited to the range of 0.04 to 2 micron and (f) the 5-SS component is copolymerized in an amount of 1.5 to 8 mole % based on the total acid component. Moreover, many unexpected effects were discovered in that the frosting phenomenon does not become an actual problem due to the specified ultrafine fiber, and when utilized in artificial leather a very soft hand and good touch of nap resulted due to the relation between PU and said fibers.

Furthermore a reduction in the dyeing cost was achieved. It was also found that when an ordinary polyester was used as the core component, that the intended objects of the present invention could not be attained at all.

DESCRIPTION OF THE PRIOR ART

U.S. Pat. No. 4,059,949 discloses a composite yarn exhibiting heather dyeing capability, which is comprised of two groups of filaments composed of two differently dyeable polymers, and teaches that one of structures for such yarn is a concentric sheath-core structure. However, in this prior art, use of ultrafine fibers is not shown, and a method of producing ultrafine fibers is not taught at all. Moreover, this prior art does not teach the use of a specific PET having a ultra-high degree of polymerization in an appropriate amount as taught by the present invention. Because the object of this prior art is heather dyeing, it is therefore not necessary to particularly increase the strength of the fibers, since the fibers have an ordinary denier and sufficient fiber strength. Moreover, other fibers having an ordinary denier are generally mixed with the foregoing fibers. Furthermore, it is required that the sheath component be much thicker than two microns. In view of this requirement, it is apparent that ultrafine fibers cannot be provided according to the above prior art technique and various unexpected effects attained by the present invention are not disclosed by this prior art technique at all.

U.K. Patent Application GB No. 2057344A, previously filed by the present inventors, discloses a spinneret for production of three component islands-in-a sea type fibers in which the island component is composed of sheath-core type ultrafine fibers. However, this prior art is irrelevant to the objects and effects of the present invention, though the apparatus used is somewhat pertinent to the apparatus used in the present invention.

In British Pat. No. 1,313,767, the present inventors proposed a process in which ultrafine fibers having crimp developed thereon are prepared by a three component spinning method. The ultrafine fibers obtained according to this prior art technique have an eccentric structure, and the development of crimp is intended. Accordingly, this prior art is apparently different from the concept of the present invention in the features and the effects. Moreover, the degree of specific ultra high polymerization and the ratio of the core component to the sheath component specified in the present invention are not disclosed by the prior art, and the thickness of the core component in the above prior art is different from that specified in the present invention.

DETAILED DESCRIPTION OF THE PREFERRED EMBODIMENTS

Figure 1:
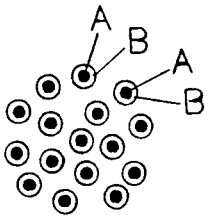
FIG. 1 is a diagram illustrative example of a section of ultrafine composite fibers of the present invention having a sheath-core structure.

The present invention relates to ultrafine sheath-core type composite fibers and united bundles thereof and to composite sheets formed therefrom.

Polyester comprising 5-SS unit as comonomer unit is dyeable with cationic dye. However, if ultrafine fibers having a size smaller than 0.5 denier are prepared from this polyester, the strength is drastically reduced, and therefore, such ultrafine fibers have no substantial practical utility. Furthermore, since these ultrafine fibers are poor in strength, they are not suitable for production of a suede-like sheet, which is one of important uses of this type of fiber, because the fibers to be raised are cut off at the buffing step and the intended raised fibers cannot be obtained. For these reasons, for the time being, such copolyester is industrially used only in the form of ordinary fiber denier.

Furthermore, spinning of such polyester is difficult, and with ultrafine fibers, this difficulty is increased seriously.

One of the objecst of this invention is to obtain a fiber, of less than 0.5 denier, having enough strength for practical use and sufficient color build up properties. Such fibers could be expected to be suitable for producing excellent artificial suede or the like or silk-like fabric and artificial furs like chinchilla, mutton, fur or mink etc. Ultrafine fibers are indispensable to some kinds of furs. The large denier fibers are not suitable for these fabrics.

In artificial leather suedes, made from non-woven fabrics, woven fabrics, knitted fabrics or combinations thereof and raised fabrics (inclusive of flocked fabrics and non-woven fabrics formed according to the paper-making method) prepared by using polyester ultrafine fibers, it was deemed necessary to develop ultrafine fibers capable of providing high-grade products excellent in slipperiness or having a moist, dewy, somewhat oily hand similar to natural suede and to use such ultrafine fibers for production of the foregoing products.

It was found that when an oiling agent or a silicone finishing agent is applied to artificial leathers, the intended slipperiness cannot be attained and even if a certain feel is obtained, it is readily removed by washing or the like.

It was also considered necessary to use ultrafine polyester fibers having a low modulus which does not strongly adhere to a polyurethane (especially, a wet coagulated product) so that high elasticity and softness should be imparted to the product. More especially, it was noted that natural leather is widely used without being impregnated with a polyurethane or the like and is used as a suede after buffing, without polyurethane.

In short, natural leathers have excellent properties manifested only by tanning, and impregnation with a polyurethane or the like is unnecessary.

In contrast, most of excellent artificial leathers have passed though the step of impregnation with a resin such as a polyurethane, and it may be said that excellent artificial leathers cannot be obtained without the impregnation treatment.

This is due to the substantial difference of the substrate structure between a natural leather and an artificial leather. For example, natural leather has a structure including many branches like withered twigs which are entangled with one another, but artificial leathers heretofore provided have only entanglements of short fibers. Accordingly, it is not reasonable to discuss natural leathers and artificial leathers on the same technical field, and the relation between fibers and polyurethane resins are delicate and important in artificial leathers. The novel excellent characteristics of the fibers of the present invention have not been noted heretofore in the art.

Research was conducted of the inventors with a view to solving the foregoing problems involved in the conventional techniques and as a result, the present invention was made.

It is a object of the present invention to provide a stronger composite sheet, for example a suede-like sheet, which can be brilliantly and deeply colored and has a slippery touch and a soft feel and which includes raised fibers resembling those of high quality natural leathers, and a preferable fiber construction that can be formed into such composite sheets.

Development of artificial leather suedes is prominent at the present and rather colorful products of a high grade have been provided.

However, a need existed to further improve the brilliance and depth of color, the touch softness, the feel and the strength.

In short, it may be said that a high-grade product having a satisfactorily brilliant and deep color has not been marketed nor developed heretofore.

Up to this time, artificial leather produced using polyamide ultrafine fibers and polyurethane is inferior in color fastness when deeply and brilliantly dyed, does not have a high quality hand because its raised fibers are often entangled and therefore cannot be successfully marketed. On the other hand, artificial leathers using polyester fibers having brilliant color are limited because they have serious disadvantages in that they must be dyed with disperse dye due to the characteristics of ultrafine fibers. There are unexpected defects in the depth, brilliance and fastness of colors when ultrafine fibers are used instead of ordinary denier fibers.

It is indeed possible to achieve much more depth of color with artificial leather than with natural leather. Nevertheless, a need for higher quality has arisen successively in studies.

It might be expected that the above need could be satisfied by dyeing fabric formed from copolymerized polyester with 5-SS. However, it has been determined that the copolymerized fiber is weak, and that it is impossible to produce a fabric which was the minimum degree of physical properties for marketing or actual use.

Furthermore, at the step of of raising the surface of the fabric by buffing, the fibers to be raised are cut off and the intended raised fibers cannot be obtained or the raised fibers are often worn out from the fabric in actual use. For that reason, for a long time, there has not been found in thre market, high quality suede having brilliant color.

Diligent research was conductored by the inventors to simultaneously satisfy such properties as physical properties, color brilliance, nap, feel, touch and appearance, and the present invention has been made.

1. In accordance with one fundamental aspect of the present invention, there is provided a polyester type sheath-core ultrafine composite fiber wherein (a) the fineness is 0.5 to 0.0001 denier, (b) the core component is located substantially at the center of the sheath component, (c) the core component is substantially composed of polyethylene terephthalate (referred to PET hereinafter) having an IV value of 0.75 to 1.2 or polybutylene terephthalate (referred to PBT hereinafter) having an IV value of 0.85 to 2.5 and the sheath component is substantially composed of a polyester copolymerized with 5-sodium (or lithium or potassium) sulfoisophthalate (referred to 5-SS hereinafter), (d) the core/sheath weight ratio is in the range of from 10/90 to 70/30 and the thickness of the sheath is 0.04 to 2 micron, and (e) the 5-SS component is copolymerized in an amount of 1.5 to 8 mole% based on the total acid components.

2. In accordance with another aspect of the present invention, there is provided a three-component type composite fiber comprising several ultrafine composite fibers as set forth above, which are united in a bundle by an interposing third component.

3. In accordance with still another aspect of the present invention, there is provided an ultrafine composite fiber as set forth above, wherein the 5-SS component is copolymerized in an amount of 2 to 2.8 mole% based on the total acid component, and the core/sheath weight ratio is in the range of from 20/80 to 55/45 and the strength is at least 3.8 g/d.

4. In accordance with a further aspect of the present invention, there is provided an ultrafine composite fiber as set forth above, wherein the polyester is one prepared by melt polymerization and subsequent solid phase polymerization.

5. In accordance with a still further aspect of the present invention, there is provided a composite sheet comprising a polyurethane and a fabric in which all or part of the component fibers are ultrafine composite fibers having a fineness of 0.5 denier or less, wherein said ultrafine composite fibers comprise a sheath component and a core component, more than half of the side face of the core component is surrounded by the sheath component, the sheath component is mainly composed of a polyester containing 5-SS and the core component is composed of a polyester formed mainly of PET having an IV value of 0.75 to 1.2 or PBT having an IV value of 0.85 to 2.5, which is free of 5-SS unit or contains said unit at a ratio smaller than in the sheath component. 6. In accordance with a still further aspect of the present invention, there is provided a composite sheet as set forth above, wherein at least the sheath component is dyed with at least a cationic dye.

7. In accordance with a still further aspect of the present invention, there is provided a composite sheet as set forth above, wherein at least the sheath component is dyed with at least a disperse dye and at least a cationic dye.

8. In accordance with a still further aspect of the present invention, there is provided a composite sheet as set forth above, wherein at least sheath component is dyed with, at least a disperse dye, and furthermore the sheet contains polyurethane.

9. In accordance with a still further aspect of the present invention, there is provided a composite sheet as set forth above, wherein the sheet after dyeing is washed in a two-bath a process comprising reduction clearing at PH-value more than 10 and soaping with anionic surface active agent.

This invention is related to the subject of ultrafine fibers having less than 0.5 denier, the technical difficulties and the uniqueness and unexpectedness of the effects.

The ordinary PET or PBT fibes of less than 0.5 denier do not have deep color and their copolymer fibers with 5-SS units for improvement of the color are weak and of little practical use.

This invention overcomes these defects. With use of fibers of more than 0.5 denier, raised fabrics do not have good touch and hand, with use of fibers of less than 0.5 denier, raised fabrics are smooth and have a good hand, and especially, in this invention, the raised fabrics are much smoother and have a better hand.

This invention simultaneously satisfies improvement of raising effects due to proper fiber strength, low adherence with polyurethane due to the specified sheath component, excellent luster due to the specified fiber denier and sheath core construction and prevention of the frosting phenomenon due to the specified fiber denier.

In the present invention, adopting the above-mentioned structure, especially by arranging a core having a very high degree of polymerization in a specific amount of 10 to 70% at the center of the sheath, the strength can be increased to an appropriate level, a brilliant and deep color can be obtained by dyeing with a cationic dye. Furthermore the problem of frosting is not practically significant in the resulting ultrafine fiber fabric. When this ultrafine fiber is formed into an artificial leather or the like, a product having a very soft feel and a good raised fiber surface can be obtained, because the adherence between the fiber and the polyurethane is not too strong. Thus, various unexpected effects can be attained according to the present invention. Furthermore, the dyeing cost can be remarkably reduced.

The present invention is described in FIGS. 1 through 7. The cross sectional sheath-core structure is shown in FIG. 1. In FIG. 1, A represents the core component and B represents sheath component.

Figure 2:
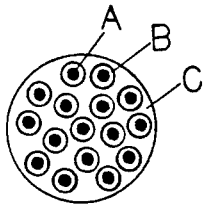
FIG. 2 is a diagram illustrative example of a section of a united bundle (three component composite fiber) of ultrafine composite fibers of the present invention.

FIG. 2 shows a most preferable example of the starting fiber for the preparation of the fiber shown in FIG. 1, that is, a united bundle of the ultrafine fibers in FIG. 1.

For facilitating understanding, the present invention is described with reference to preferable means for attaining the objects of the present invention. However, the present invention is not limited by such means as described below. First, a cross section of a three component composite fiber is diagrammatically shown in FIG. 2. In this islands-in-a sea composite fiber, islands constitute sheath-core fibers. In FIG. 2, A represents the core of the islands, which is substantially composed of PET, PBT or a copolymer thereof, having a very high degree of polymerization. This polyester does not contains 5-SS units or if these units are contained therein, the content of these units is lower than in the sheath B. It is ordinary preferred that A is composed of a homopolymer, that is PET or PBT.

The sheath B is substantially composed of a polyester containing 5-SS unit. It is preferred that the sheath B is substantially composed of a copolymer of 5-sodium sulfoisophthalate of the polyester of the core A. It is indispensible that the copolymerization ratio of the 5-SS the component be 1.5 to 8 mole%, preferably 1.9 to 5.0 mole %, especially preferably 2 to 2.8 mole%, based on the total acid components. This copolyester is arranged as the sheath of the island component, and it is preferred that the sheath should surround the surface of the core component without high eccentricity, though it may surround the core thinly.

If the sheath does not properly surround the core, good color properties cannot be obtained and the fibers are easily entangled with each other by rub or chafe due to crimp formation.

The copolymer of the sheath component exhibits a high apparent viscosity in the molten state as compared with its intrinsic viscosity IV (described hereinafter).

In order to ensure sufficient strength, it is preferred that the intrinsic viscosity (IV) of the core component is as high as possible within the allowable range. It is required that the intrinsic viscosity of core component A be higher than that of the sheath component. If this requirement is not satisfied, the intended objects of the present invention cannot be attained. It is preferred that the intrinsic viscosity of the core component is higher by at least 0.1, especially by at least 0.15, than the intrinsic viscosity of component B. If this requirement is satisfied, high strength is manifested when the fiber is drawn at an elongation lower than 100%, especially at an elongation of 10 to 65%.

Component C in FIG. 2 is a so-called sea component, and if this component is removed as occasion demands, the fiber of the present invention as shown in FIG. 1 is formed. The thickness of the fiber of the present invention is preferably 0.0001 to 0.5 denier, especially preferably 0.25 to 0.05 denier. This requirement influences the dye fastness, the color properties and the hand. If this requirement is satisfied, the effects of the present invention are most prominent.

The cross-sectional shape of the fiber is not limited to a circular shape but the fiber can take any cross-sectional shapes desired.

The intrinsic viscosity is measured, for example, in o-chlorophenol at 25° C. The strength of the ultrafine composite fiber AB of the present invention is at least 3.4 g/d, preferably at least 3.8 g/d.

In order to maintain sufficient strength, it is required that the ratio of the component A in fiber AB of the present invention be 10 to 70% by weight, preferably 20 to 55% by weight.

In order to impart good coloring properties, it is required that the thickness of the section of the sheath component, as determined by a scanning type electron microscope, be 2 microns or less, preferably 0.04 to 2 microns. In the fiber of the present invention, the core component is not strongly eccentric as a whole.

In order to obtain uniform dyeing and to avoid entanglement of the nap, it is preferred that formation not be caused in the sheath-core fiber only by shrinkage under heating. For example, an eccentric structure should not be avoided, but a substantially concentric circular section is adopted so that crimp formation does not occur.

In the fiber of the present invention, the component B is a copolymer having ethylene terephthalate or butylene terephthalate units as main recurring units and 5-SS units in an amount of at least 1.5 mole% based on the total acid components. If the content of the 5-SS units is lower than 1.5 mole%, the tendency toward light coloration due to fiber fineness below 0.5 d is not sufficiently compensated for by the deep coloring effecting attained by the presence of the 5-SS units, and the slipperiness, touch and softness cannot be improved. In the present invention, this disadvantage of frosting is eliminated by adjusting the fineness of the fiber to 0.5 denier or less.

In the present invention, it is required that a polyester composed mainly of ethylene terephthalate units or butylene terephthalate units be used as the component A. Furthermore, the intrinsic viscosity of this polyester should be higher by at least 0.08, preferably by at least 0.12, than the intrinsic viscosity of the polyester of component B. A homopolymer such as polyethelene terephthalate or polybutylene terephthalate is preferable as the core component.

By the use of such polyester, the strength can be significantly increased according to the present invention. It is especially preferred that this polyester be prepared by melt polymerization and subsequent solid phase polymerization. The reason is that a product having a high degree of polymerization can easily be obtained and improved physical properties can be obtained due to a reduction in the formation of by-products by side reactions.

The intrinsic viscosity is determined in o-chlorophenol at 25° C. When the polymer is dissolved in the solvent, the solution may be heated, but the temperature should be adjusted to precisely 25° C. at the time of measurement.

By adopting the structure of the present invention, spinning or drawing can be performed easily within yarn breakage or formation fluffs. In the present invention, the balance of the melt viscosity is much better between the components A and B at the spinning step than with a composite fiber having component B, without 5-SS, at the same intrinsic viscosity.

If the intrinsic viscosities of the components are close to each other or if the intrinsic viscosity of the core component is low, the strength-improving effect of the present invention is not substantially attained (See Comparative Example given hereinafter). Since the apparent melt viscosity is abnormally increased at the spinning step with a component containing 5-SS units at high content, stable spinning becomes impossible. In order to eliminate this disadvantage, it is preferred that the intrinsic viscosity (IV) of component A be higher by at least 0.08 than the intrinsic viscosity (IV) of component B. This feature is also important for increasing the frosting resistance.

It is preferred that intrinsic viscosity of the component A be 0.75 to 1.2 in case of polyethylene terephthalate or 0.85 to 2.5 in case polybutylene terephthalate.

The spinneret for formation of a three-component fiber having a section as shown in FIG. 2 has already been proposed by one of the present co-inventors, and where this spinneret is used, three-component spinning can be performed very smoothly. The bundle as shown in FIG. 2 ordinarily includes 1 to 10,000 fibers, preferably 5 to 250 fibers, especially preferably 10 to 80 fibers. If sea component C is removed or separated after spinning and drawing, the intended fiber as shown in FIG. 1 is obtained.

Thus, according to the present invention, there is provided a fiber suitable for formation of ultrafine composite fibers. According to the present invention, an ultrafine composite fiber comprising the components A and B can easily be obtained from such fiber by removing the component C. When the final ultrafine fibers are subjected to carding, spinning, weaving, knitting, webbing or flocking, such processes are some times difficult, or problems may arise. In such cases, a method may be easily adopted whereby a plurality of ultrafine fibers united by the component C are utilized. Bundles of the three component fiber are subjected to the processes, and after processing component C is removed. Furthermore, a method may be adopted in which a fabric composed of the ultrafine fibers, for example, a non-woven fabric, is impregnated with component C to unite these ultrafine fibers. If necessary, the fabric or the like may be impregnated with another component B as well as component C. After such impregnation, component C is removed. The type of the component is not particularly critical, as long as it can be removed by a solvent or decomposing agent or by mechanical means without any significant influence on the composite fiber AB. Namely, the component C may be chosen among various polymers or binders appropriately according to the the intended objects and uses.

In this invention, IV values are measured and defined according to the following methods.

(1) IV Measurement Method A:

This method is adopted when the polymer is not readily soluble or the IV value is found to be larger than 1.0 at the preliminary test.

First, 10 ml of o-chlorophenol are added to 0.8 g of polymer, and the mixture is immersed in a bath maintained at 160° C. and stirred for 60 min. using a magnetic stirrer to dissolve the polymer. A capillary tube viscometer is charged in a water bath maintained at 25° C., and the flowdown time is measured and the relative viscosity (eta r) is determined from the ratio of the flowdown time. The IV value is calculated according to the following formula:

$$IV=0.0242(eta\ r)+0.2634$$

(2) IV Measurement Method B: (IV less than 1.0)

The IV value is determined in the same manner as described in measurement method A except that the mixture of the polymer and o-chlorophenol is immersed in a bath maintained at 100° C. and the polymer is dissolved by applying ultrasonic vibrations for 30 min.

The pure core sample to be subjected to the above-mentioned method A or B is collected by dipping the sheath-core fiber into a 5% solution of NaOH, boiling the solution, dissolving the residue in the solution at about 85° C., washing with water and then drying at 100° C. The fiber is dissolved in an amount such that the weight of the core component becomes slightly less than the weight of the core component calculated from the core-sheath ratio. Namely, all of the sheath and surface of the core are dissolved off. The sheath is more easily dissolved out than the core because the sheath component contains 5-SS units.

In the present invention, the "intrinsic viscosity (IV) is the value determined by the above described method A or B according to the above calculation.

Incidentally, the IV value of the polymer is reduced during spinning. Accordingly, the IV value is determined with respect to the fiber according to the above-described method A or B.

The properties of the ultrafine composite fiber of the present invention are as follows.

(1) Since the fiber is ultrafine and the copolymerized 5-SS component-containing polymer is exposed to the surface, a product havin a soft touch can be obtained.

(2) The strength is high and practically applicable ultrafine fiber can be provided even though this cannot be achieved with a fiber composed solely of component B. This effect of improving the strength is unexpected, surprising and contrary to the ordinary technical concept that the strength of the composite fiber is very strongly influenced by the weaker component.

(3) Since the polymer containing 5-SS is exposed to the surface, a product having good slipperiness can be obtained.

(4) The Young's modulus is not too high or not too low. If the Young's modulus is too high, the good feel and good hand are reduced, and if the Young's modulus is too low, the hand is poor.

(5) The fiber can be dyed with a cationic dye although the fiber is ultrafine, the fiber can be dyed a deep and brilliant color.

(6) The fiber can be dyed with one or more cationic dyes, with one or more disperse dyes or a combination thereof. The fabric may be dyed with one or more disperse dyes only.

(7) Special color effects can be attained by using a mixture of dyes.

(8) When polyurethane is used, a special feel (soft and somewhat moist feel) can be given to the product. The reason is that the adhesiveness to the polyurethane is reudced and the synergistic effect can be attained by the 5-SS-containing polymer (in case of wet coagulation).

(9) The fiber can be spun stably and spinnability is very good in spite of three components.

(10) The occurrence of yarn breakage is substantially prevented at the spinning step.

(11) The occurrence of yarn breakage is extremely reduced at the drawing step and formation of fluffs is rare.

(12) The fiber can be mixed with other fibers. Since the strength difference is small, falling out or breaking off of only the fiber of the present invention does not occur while the product is actually used. This property is especially prominent when buffing is carried out for the purpose of raising.

(13) Even if component B is deteriorated by an alkali, the damage is reduced to a very low level because of the presence of component A because component B is combined with a component having a high alkali resistance.

(14) Control of elongation can be very easily effected.

(15) Frosting is not conspicuous in actual use.

In the present invention, the sheath component (component B) does not only perform the function of surrounding core component with a the cationic dyeable component in the ultrafine fiber, but it also has an important relationship to elastomers, such as a PU, and to the slipperiness, feel and hand when the fiber is processed into an artificial leather. In short, component B provides excellent properties.

These properties will now be described by comparing an artificial leather prepared by using the ultrafine composite fiber of the present invention with an artifical leather prepared by using an ultrafine fiber composed solely of 100% PET having an ordinary degree of polymerization.

(1) The product of the present invention can be dyed with a cationic dye, and the dyeing cost can be reduced.

(2) The product of the present invention can be dyed with a cationic dye and also with a disperse dye, and when this dyeing method is adopted, a deep color having the highest brilliance can be imparted.

(3) The strength of the product of the present invention is higher than the strength of the product composed solely of component B, and also sheet strength becomes higher.

(4) In the buffing operation, a high quality of raised fibers comparable to those obtained by using PET alone can be obtained.

(5) The hand is softer than the hand of a product obtained using PET alone. The reasons is that component B has a much reduced adhesiveness to polyurethane applied using ordinary wet coagulation. That is, the adhesiveness of component B to the polyurethane is lower than that of component A. The fiber of the present invention has lower modulus than 100% PET fibers. Thus, good softness and bulkiness can be imparted to the product.

(6) Good slipperiness and a soft hand can be imparted to the product. Since the fiber of present invention is ultrafine, the product of the present invention should naturally possess such properties. According to the present invention, the effects (5) and (6) can be enhanced beyond expected levels.

The reason is that peculiar effects other than dyeing properties can be provided by the 5-SS group being present in the molecule and the Young's modulus of that portion of component B is low.

Figure 3:
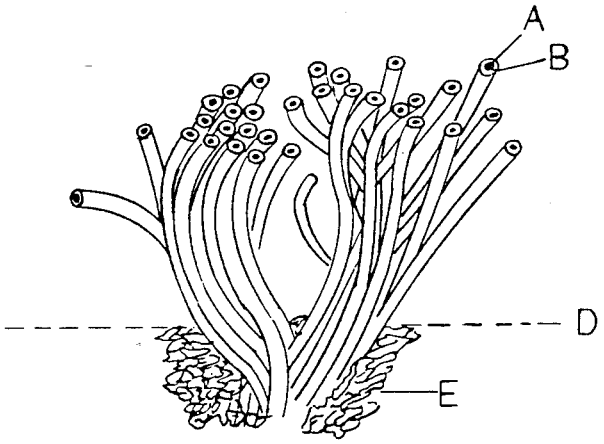
FIG. 3 is an enlarged partial diagram illustrating the surface state of an example of composite sheets (raised product) prepared by using the ultrafine composite fibers of the present invention.

FIG. 3 is a view diagrammatically illustrating the raised portion of a raised composite sheet prepared using the fiber of the present invention. In FIG. 3, D represents the surface of the composite sheet not inclusive of the raised fibers, and E represents a polyurethane elastomer. It is considered that the adhesiveness of fiber AB to elastomer E around the fiber are changed. By such change, the feel and hand can further be improved.

If a fabric formed of the ultrafine composite fiber of the present invention is impregnated with polyurethane, it may be raised or may not be raised. A grain layer composed of polyurethane or other polymer may be formed on the fabric according to need. As the fabric, there may be used a non-woven fabric, a woven fabric, a knitted fabric and combinations thereof. Such fabric need not be composed completely of the ultrafine composite fiber of the present invention, but the fiber of the present invention may be used at an optional ratio or optional parts according to the intended object and use, so far as attainment of the objects of the present invention is not substantially inhibited. With a raised product, it is preferred that the majority of the raised portion be composed of the fiber of the present invention.

Since the ratio of impregnation with PU is changed according to the intended object and use, in general, it is difficult to specify the quantity of the PU. But, for example, where a non-woven fabric is used, the amount of the PU is 15 to 120% by weight based on the fiber, and weight where a woven or knitted fabric is used, the amount of PU is 1 to 20% by weight based on the fiber weight.

Ordinarily, natural leather can be used without impregnation with an elastomer (PU, in this inventiion, although the elastomer is not always restricted to PU, for example, acrylic rubber, butadiene rubber, natural rubber, silicone rubber, vinyl rubber may be used) and gives high grade product. However, in case of artifical leather, a high-grade product cannot be obtained without impregnation of PU. This is due to the fact that the artificial leather is essentially different from the natural leather. In the natural leather, the fibers comprise branches entangled with one another and it seems not to be true that they are merely bonded together.

Accordingly, the relation of the fiber to the PU is very important and is one of important features of the present invention. This feature is not directly relevant to the color or dyeing.

Furthermore, PU has an important relation to a disperse dye or basic dye. When the fiber of the present invention is dyed with both the dyes in one bath, it is preferred that the reduction clearing after dyeing is carried out with a solution containing hydrosulfite and caustic soda. In this case, the strength of component B is sometimes reduced to some extent, but the prominent properties of the present invention are not degraded at all.

The present invention is described in detail with references to the following examples that by no means limit the scope, usefulness and validity of the invention. Furthermore, broadening of the application field of the present invention will be suggested by these Examples.

EXAMPLE 1

An islands-in-sea composite fiber was spun from PET having an IV value of 1.15 (as measured according to the method described herein above) as the core component A of the island component, poly(ethylene terephthalate/5-sodium sulfoisophthalate) copolymer (the content of the 5-SS being 2.43 mole% based on dimethylterephthalate) having an IV value of 0.58 as the sheath component B of the island component, and poly(styrene/2-ethylhexyl acrylate) copolymer (the content of 2-ethylhexyl acrylate being 22 weight %) having an (eta bracket) value of 1.01 (as measured according to method (A) described below) as sea component C, using a spinneret having an island-in-sea structure including sheath and core in the island (see FIG. 1A of UK Patent Application No. 2,057,344) at a melt temperature of 295° C. The island/sea weight ratio was 57/43, and the core/sheath weight ratio was adjusted to 0/100, 25/75, 35/65, 50/50, 65/35, or 100/0. Then, the spun fiber was cooled, treated with an finishing agent and wound at a speed of 1280 m/min.

The (eta bracket) value of the sea component was measured according to the following method.

(A) To 0.5 g of the polymer was added 50 ml of toluene and the polymer was dissolved. The flow-down time was measured at concentrations of 1X, $\frac{2}{3}$X, $\frac{1}{2}$X and $\frac{1}{3}$X, respectively, in a water bath maintained at 30° C. using a capillary tube viscometer and the relative viscosity (eta r) was determined. The (eta bracket) value was determined by extrapolation according to the following formula:

$$\text{(eta bracket)} = \text{limit c approaches to o } (1/c)\log_e(\text{eta r})$$

The obtained undrawn fiber was drawn at 80° C. at a draw ratio of 2.98 and drawing speed of 60 m/min using a hot liquid bath drawing machine to obtain a 150 d/36 f composite drawn yarn.

Figure 4:
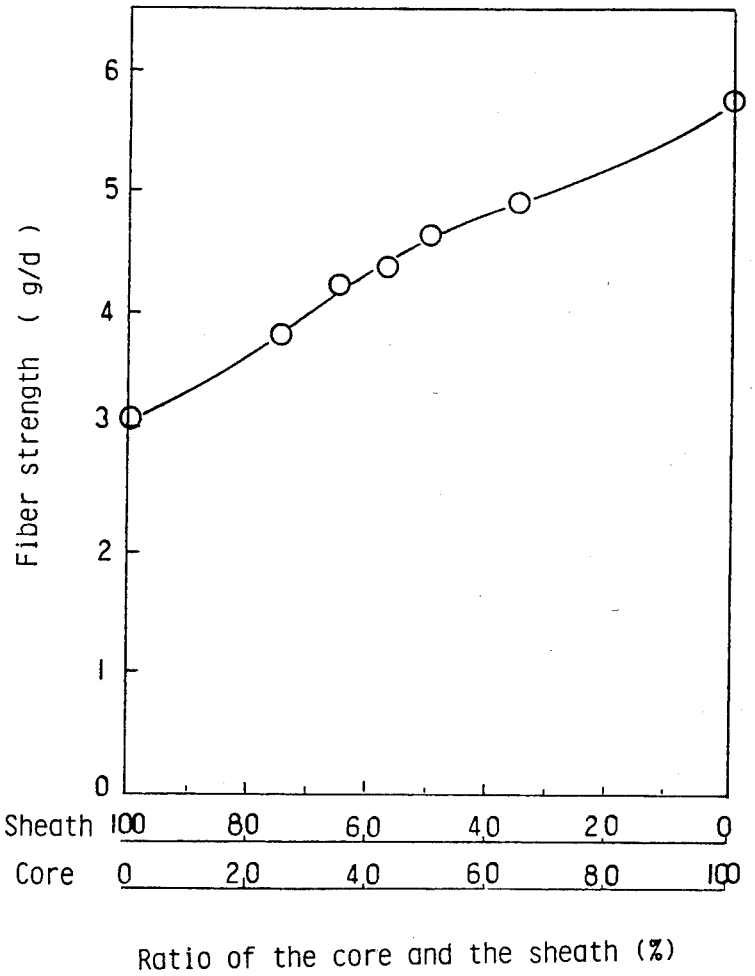
FIG. 4 is a diagram illustrating the relation between the ratio of the core and sheath components and the fiber strength, which is obtained in Example 1.

FIG. 4 illustrates the relation between the strength of the island component, after removing the sea component of the drawn yarn using carbon tetrachloride, and the core/sheath ratio. As is apparent from FIG. 4, in the fiber of the present invention, sufficient strength can be maintained, even though a polymer having low strength is used as the sheath component.

The composite drawn yarn was formed into a knitted cylindrical fabric (sample hosiery type), and the fabric was immersed in trichloroethylene, squeezed by a mangle and dried at 100° C. to obtain a knitted cylindrical fabric composed substantially solely of the island component at a sea removal ratio of 99.5%.

The resulting knitted cylindrical fabric was treated in a circulating type high temperature dyeing machine and dyed with Aizen Cathilon Navy Blue CD-RLH(supplied by Hodogaya Kagaku Co. Ltd.) at a dye concentration of 20% owf and a dyeing temperature of 120° C. for 60 minutes. Acetic acid (0.6 g/l), sodium acetate (0.4 g/l) and Glauber salt (3 g/l) were used as auxiliary agents. The dyed fabric was washed with water and then washed with warm water containing acetic acid (0.2 g/l) and an anionic surfactant (Laccol PSK supplied by Meisei Kagaku Co. Ltd) (2 g/l) at 60° C. for 20 minutes. Then an antistatic agent (Silstat #1173 supplied by Sayo Kasei Co. Ltd) and a softener (Babiner S-783 supplied by Marubishi Yuka Co. Ltd) were added. After that, the fabric was dried at 80° C.

Figure 5:
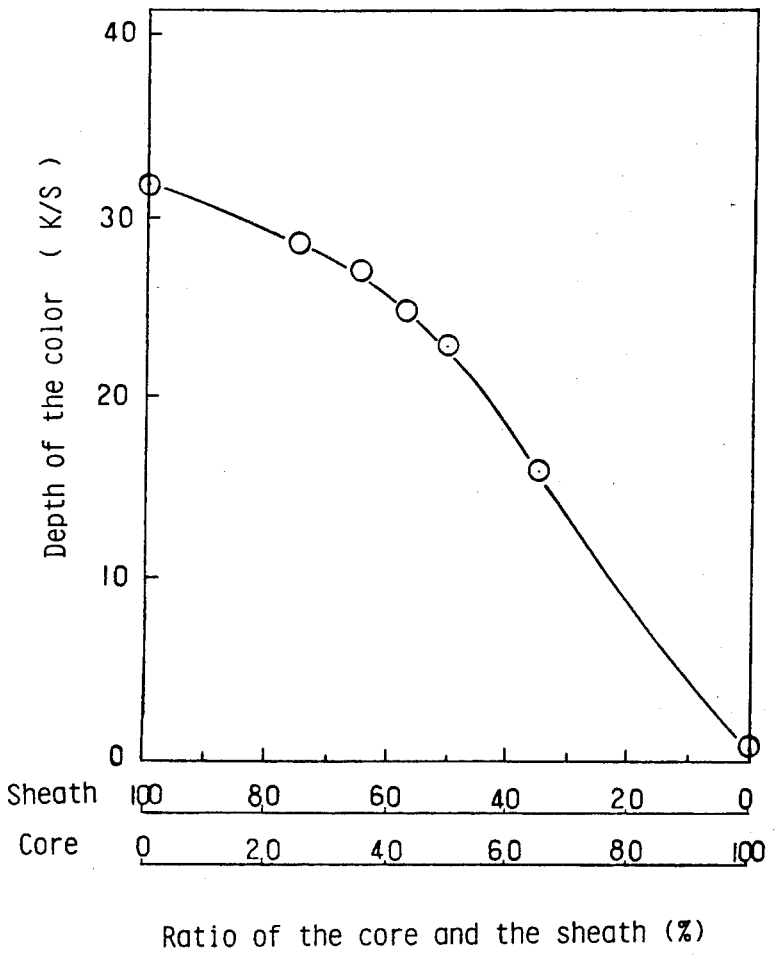
FIG. 5 is a diagram illustrating the relation between the ratio of core and sheath components and the depth of color using cationic dye, which is obtained in Example 1.

The color depth (K/S value measured at the wave length of maximum absorption respectively) of the so-obtained knitted cylindrical fabric was measured by using a spectrophotometer (Model Macbeth MS-2000 supplied by Kollmorgen Co. Ltd), where K/S is known as "function of KUBELKA-MUNK" and gives one of the measures of the color depth. The obtained values of the respective sheath-core ratio was plotted to obtain FIG. 5. As shown in FIG. 5, it was found that as the ratio of the sheath component is increased, the color depth is enhanced. When FIGS. 4 and 5 are examined in combination, it may be seen that a sufficient coloring effect can be attained in the range where the strength of the sheat components can be reinforced. It was confirmed that as the ratio of the sheath component is increased, a brilliant and deep blue color can be imparted to the knitted cylindrical fabric.

EXAMPLE 2

The undrawn yarn obtained in Example 1 (island/sea weight ratio=57/43, core/sheath weight ratio in the island component=25/75) was drawn by a two-staged hot liquid bath drawing machine using a preheating bath temperature of 55° C., a first liquid bath temperature of 80° C. and a second liquid bath temperature of 70° C., with a draw ratio of 3.15 and a drawing speed of 60 m/min. The drawn yarn was crimped so that the crimp number was 12 crimps per inch.

The crimped yarn was sprayed with a silicone type fiber finishing agent, dried at 40° to 50° C. and cut to 51 mm lengths by a cutting machine to obtain a raw fiber-1 having the following properties.

Fineness of composite fiber: 3.36 denier
Strength of composite fiber: 2.77 g/d
Elongation of composite fiber: 45.7%
Strength of island component: 3.90 g/d
Elongation of island component: 47.2%
Number of crimp: 12.2 crimps per inch
Cut length: 15.1 mm
IV value of core component after removal of sheath from island: 0.783

The obtained raw fiber-1 was passed through a carding machine and cross-lapper to form a web having a weight of 160 g/m$^2$. Three of the so-formed webs were overlapped together and then needle-punched to obtain a non-woven fabric having a weight of 556 g/m$^2$ and apparent density of 0.213 g/cm$^3$ with a needle density of 4000 needles/cm$^2$.

The nov-woven fabric was passed through hot water maintained at 85° C. and mangle-nipped with a certain clearance (0.75t t=thickness). The shrunk non-woven fabric was dried at 80° C. until the weight was not changed. The area shrinkage ratio was 27.2%.

The non-woven fabric was dipped in a polyvinyl alcohol (referred to PVA hereinafter) bath having a concentration of 14% in water, which was maintained at 40° to 50° C., and was mangle-nipped, so that 25 parts of PVA were applied to 100 parts of the fiber. This was determined by measurement of the weight of sheet. The fabric was passed once through a hot air-circulating dryer at 150° C. and then dried at 85° C. until the weight became constant.

Then, the fabric was dipped in trichloroethylene and nipped by a mangle with a certain clearance (0.65t) 35 times repeatedly, and the fabric was dried at 100° C. until the weight became constant. The sea component removal ratio was 99.3% by weight.

Then, the fabric was dipped into a dimethylformamide (referred to DMF hereinafter) solution of polyurethane having a concentration of 14% and containing carbon black in an amount of 0.08% by weight based on the polyurethane solids and mangle-nipped so that 47 parts of PU resin were applied to 100 parts of the fiber. Then, the fabric was dipped into a water bath maintained at 30° C. for two hours to coagulate the resin.

The obtained composite sheet was dipped into hot water maintained at 85° C., was squeezed by a mangle to remove PVA and the solvent, and was then dried at 100° C. A sheet having a weight of 627 g/m$^2$ and the apparent density of 0.327 g/cm$^3$ was obtained.

The sheet was sliced into two halves by a slicing machine, and the surfaces of the sliced sheet were buffed using a belt sander buffing machine provided with a 100 mesh sand paper. A raised sheet having a weight of 250 g/m$^2$, and apparent density of 0.346 g/cm$^3$ and a thickness of 0.74 mm was obtained.

Sheets thus obtained were treated in a circulating high temperature dyeing machine and dyed with a cationic dyes, that is, Aizen Cathilon Red K-GLH (supplied by Hodogaya Kagaku Co. Ltd) (filled circle in FIG. 6), Aizen Cathilon Blue CD-RLH (supplied by Hodogaya Kagaku Co. Ltd) (filled square in FIG. 6) or Diacryle yellow 3G-N (supplied by Mitsubishi Kasei Co. Ltd) (filled triangle in FIG. 6) at a dye concentration of 10, 15 or 30% owf and a dyeing temperature of 120° C. for 60 minutes. Acetic acid (0.6 g/l), sodium acetate (0.4 g/l) and Glauber salt (3 g/l) were used as dyeing auxiliary agents.

Each dyed sheet was washed with water and dipped into water containing 0.2 g/l of acetic acid and 2 g/l of an anionic surface active agent (Laccol PSK supplied by Meisei Kasei Co. Ltd), which was maintained at 60° C. for 20 minutes. Then, an antistatic agent (Silstat #1173 supplied by Sanyo Kasei Co. Ltd) and a softener (Babiner S-783 supplied by Marubishi Yuka Co. Ltd) were added. After that, each sheet was brushed along the raising direction and was then dried at 80° C.

For comparison, sheets obtained by using PET alone for the island component were dyed with three disperse dyes, that is, Palanil Yellow 3G (supplied by BASF) (hollow triangle in FIG. 6), Resolin Blue BBLS (supplied by Bayer) (hollow square in FIG. 6) or Kayalon Polyester Light Red B-S (supplied by Nippon Kayaku Co. Ltd) (hollow circle in FIG. 6), at a dye concentration of 10, 15 or 30% owf and a dyeing temperature of 120° C. for 60 minutes. Wet Softer AS (supplied by Ipposha Yushi Co. Ltd) (0.6 g/l), Mignol #4000N (supplied by Ipposha Yushi Co. Ltd) (0.5 g/l) and a 50% solution of a ½ mixture of acetic acid/sodium acetate (1.0 g/l) were used as auxiliary agents.

Each dyed sheet was washed with water and dipped into water containing 1.2 g/l of Sandet G-29 (supplied by Sanyo Kasei Co. Ltd), 0.9 g/l of hydrosulfite and 0.9 g/l of 36 Baume degree NaOH, which was maintained at 80° C., for 20 minutes. Then, antistatic agent (Silstat #1173 supplied by Sanyo Kasei Co. Ltd) and a softener (Babiner S-783 supplied by Marubishi Yuka Co. Ltd) were added. After that, each sheet was brushed along the raising direction and was then dried at 80° C.

Figure 6:
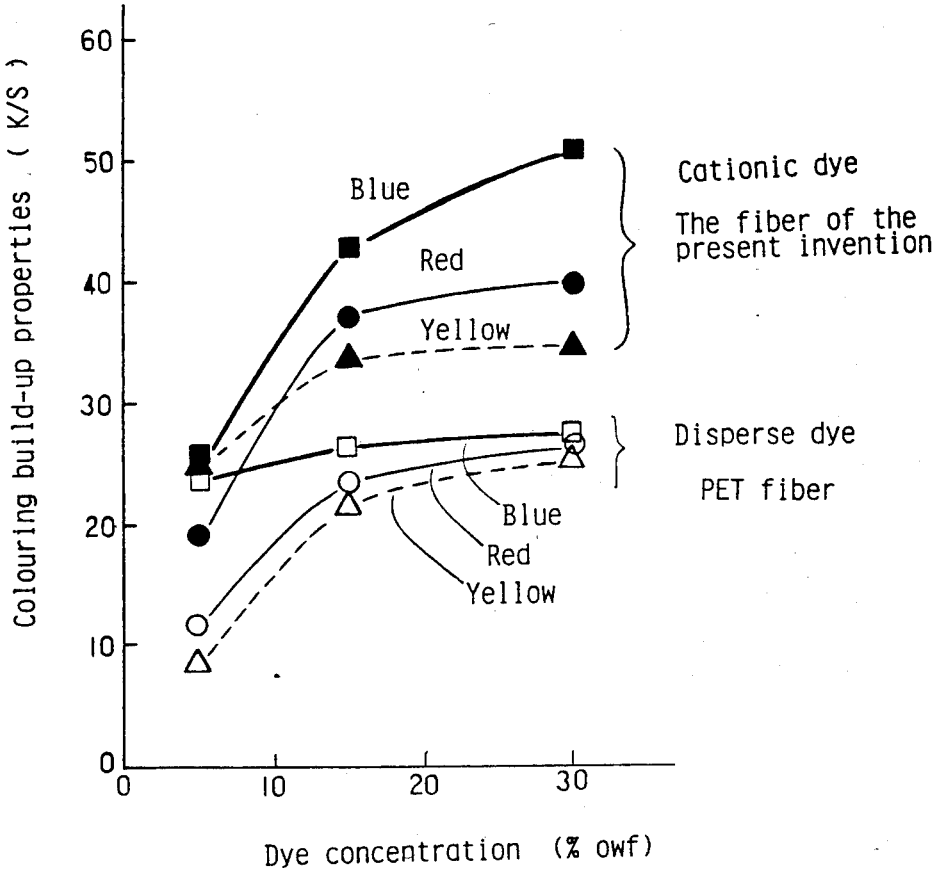
FIG. 6 is a diagram illustrating results of comparison of color build up properties of fibers of the present invention using a cationic dye at various dye concentrations with color build up properties of the fibers composed of FET alone using a disperse dye at various dye concentrations, which are obtained in Example 2.

The color depth (K/S value) of each of the raised sheets dyed the three primary colors with the cationic dyes, was determined by using a spectrophotometer (Model Macbeth MS-2000). The relation between the color depth and the dye concentration is shown in FIG. 6. From FIG. 6, it is readily apparent that the fiber of the present invention has excellent coloring properties with respect to each of the three primary colors at each dye concentration.

EXAMPLE 3

A composite yarn was spun from PET chips having an IV value of 0.72 (as measured according to the method described in the specification) as the island component and polystyrene pellets having an (eta bracket) value of 0.665 and containing 5.0% by weight of polyethylene glycol as the sea component, at a melt temperature of 285° C. using a spinneret having a sea/island structure. The island/sea weight ratio was 57/43. The spun fiber was cooled, treated with an finishing agent and wound at a speed of 1400 m/min.

The resulting undrawn yarn was drawn by a wet-heat drawing method at a heating steam temperature of 150° C., a draw ratio of 2.5 and drawing speed of 110 m/min., and the drawn yarn was crimped so that the crimp number was 12 crimps per inch. The crimped yarn was dried at 45° to 55° C. and was cut into 51 mm lengths. A raw fiber-2 having the following properties was obtained.

Fineness of composite fiber: 3.76 denier
Strength of composite fiber: 2.45 g/d
Elongation of composite fiber: 53.5%
Strength of island component: 4.42 g/d
Elongation of island component: 82.8%
Crimp number: 11.5 crimps/inch
Cut length: 51 mm Raw fiber-2 was mixed with raw fiber-1 obtained in Example 2 (island/sea weight ratio=57/43, core/sheath weight ratio in the island component=25/75) at a fiber-1/fiber-2 weight ratio of 70/30.

The obtained mixed raw fibers were passed through a carding machine and cross lapper to form a web having a weight of 160 g/m$^2$. Three of the so-formed webs were overlapped together and then needle-punched to obtain a non-woven fabric having a weight of 528 g/m$^2$ and an apparent density of 0.192 g/cm$^3$ with a needle desity of 3000 needles/cm$^2$.

The non-woven fabric was passed through hot water maintained at 85° C. and mangle-nipped with a certain clearance (0.75t). The shrunk non-woven fabric was dried at 80° C. until the weight was not changed substantially. The area shrinkage ratio was 33.2%.

The non-woven fabric was dipped in a PVA bath having a concentration of 12.5% in water, which was maintained at 40° to 50° C., and was mangle-nipped, so that 25 parts of PVA was applied to 100 parts of the fiber. Then, the fabric was passed once through a hot air-circulating drier at 150° C. and was dried at 85° C. until the weight became substantially constant.

Then, the fabric was dipped into trichloroethylene and nipped by a mangle with a certain clearance (0.65t) 35 times repeatedly, and the fabric was dried at 100° C. until the weight became constant. The sea component removal ratio was 99%.

Then, the fabric was dipped in a DMF solution of PU having a concentration of 14% containing carbon black in an amount of 0.08% by weight based on the PU solids and mangle-nipped so that 47 parts of the PU resin were applied to 100 parts of the fiber. Then, the fabric was dipped into a water bath maintained at 30° C. for 2 hours to coagulate the resin.

The obtained composite sheet was dipped in hot water maintained at 85° C., was squeezed by a mangle to remove the PVA and the PU solvent, and was then dried at 100° C. A sheet having a weight of 665 g/m$^2$ and an apparent density of 0.312 g/cm$^3$ was obtained.

The sheet was sliced into two halves by a slicing machine, and the surfaces of the sliced sheet were buffed using a belt sander buffing machine provided with a 100-mesh sand paper. A raised sheet having a weight of 238 g/m$^2$, an apparent density of 0.310 g/cm$^3$ and a thickness of 0.77 mm obtained.

The sheet was treated in a circulating type high temperature dyeing machine (supplied by Hisaka Co. Ltd) and dyed with cationic dyes, that is, 8.57% owf of Diacryle Yellow 3G-N (supplied by Mitsubishi Kasei Co. Ltd), 4.28% owf of Aizen Cathilon Red K-GLH (supplied by Hodogaya Kagaku Co. Ltd) and 2.14% owf of Aizen Cathilon Blue CD-RLH (supplied by Hdogaya Kagaku Co. Ltd) at a temperature of 120° C. for 60 minutes. Acetic acid (0.6 g/l), sodium acetate (0.4 g/l) and Glauber salt (3 g/l) were used as dyeing auxiliary agents.

The dyed sheet was washed with water and dipped in water containing 0.2 g/l of acetic acid and 2 g/l of an anionic surface active agent (Laccoal PSK supplied by Meisei Kasei Co. Ltd), which was maintained at 60° C. for 20 minutes. Then, an antistatic agent (Silstat #1173 supplied by Sanyo Kasei Co. Ltd) and a softener (Babiner S-783 supplied by Marubishi Yuka Co. Ltd) were added. After that, the sheet was brushed along the raising direction and was then dried at 80° C.

In the resulting raised sheet, only the fiber of the island component having the sheath-core structure was deeply and brilliantly dyed a moss green color as the base color, and the raised sheet had "mélange" (mixed) colors and the good hand and feel of a high quality product.

EXAMPLE 4

A composite fiber was spun from a poly(ethylene terephthalate/5-SS)copolymer (5-SS content is 2.43 mole% based on dimethylphthalate) having an IV value of 0.58 (as measured according to the method described herein above) as the island component and polystyrene having an (eta bracket) value of 0.665 as the sea component, at a temperature of 285° C. by using a spinneret having a "islands-in-sea" type structure. The island/sea weight ratio was 80/20. The spun fiber was cooled, treated with finishing agent and taken up at a speed of 1280 m/min.

The resulting undrawn yarn was drawn by a wet-heat drawing method at a heating steam temperature of 150° C., a draw ratio of 2.85 and a drawing speed of 80 m/min., and the drawn yarn was crimped so that the crimp number was 14 crimps/inch. The crimped yarn was dried at 45° to 55° C. and was cut into 51 mm lengths. A raw fiber-3 having the following properties was obtained.

Fineness of composite fiber: 3.27 denier
Strength of composite fiber: 2.41 g/d
Elongation of composite fiber: 44.6%
Strength of island component: 3.04 g/d
Elongation of island component: 78.7%
Crimp number: 13.5 crimps/inch
Cut length: 51.3 mm Raw fiber-2 obtained in Example 3 was mixed with raw fiber-1 obtained in Example 2 at a fiber-1/fiber-2 weight ratio of 0/100, 30/70, 70/30 or 100/0.

The obtained mixed fibers were passed through a carding cross lapper and then needle-punched. Non-woven fabrics F-1 having weights in the range of 540 to 568 g/m$^2$ and densities in the range of 0.18 to 0.208 g/cm$^3$ with needle densities in the range of 3000 to 3500 needles/cm$^2$ were obtained.

Raw fiber-3 was mixed with raw fiber-2 obtained in Example 3 at a fiber-3/fiber-2 weight ratio of 30/70, 70/30 or 100/0.

The obtained mixed fibers were passed through a carding machine, cross lapper and then needle-punched. Non-woven fabrics F-2 having weights in the range of 530 to 560 g/m$^2$ and apparent densities in the range of 0.185 to 0.207 g/cm$^3$ with needle densities in the range of 3000 to 3500 needles/cm$^2$ were obtained.

Figure 7:
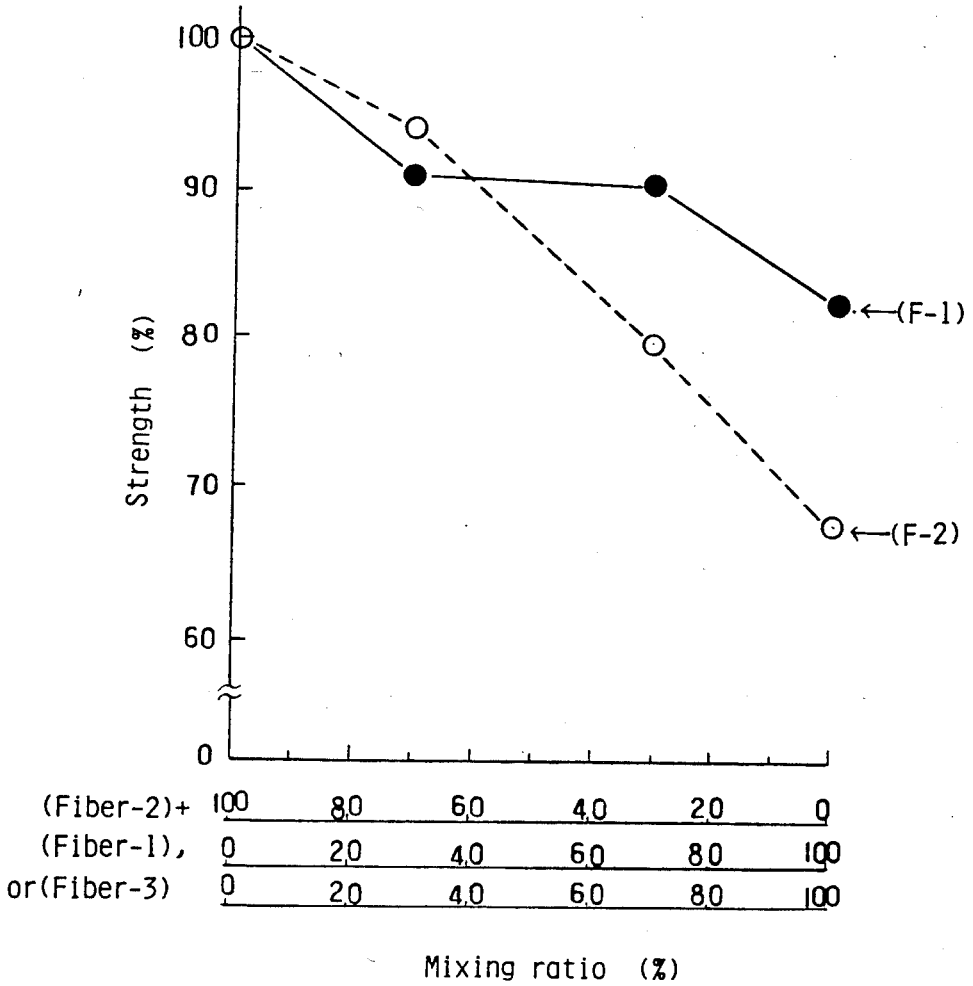
FIG. 7 is a diagram illustrating strength characteristics of felts, before removing the sea component, prepared by mixing fibers of the present invention with PET fibers at various mixing ratio (strength characteristics of felts prepared by mixing fibers formed solely of the sheath component with PET fibers at various mixing ratios are simultaneously shown), which are obtained in Example 4.

The tensile strength of each of the non-woven fabrics, F-1 and F-2, were measured by using a tensile testing machine ("Tensilon" by Tokyo Seiki Co. Ltd). The obtained results are plotted in FIG. 7 according to following manner. In FIG. 7, the relative values (strength retention ratios), calculated based on the supposition that the strength of a non-woven fabric produced using the raw fiber-2 alone is 100%, are shown.

As shown in FIG. 7, it was found that when raw fiber-3 prepared using the poly(ethylene terephthalate/5-sodium sulfoisophthalate)copolymer (the 5-sodium sulfoisophthalate content being 2.43 mole% based on dimethylterephthlate) alone as the island component is mixed, the strength retention ratio of the non-woven fabric is reduced when the mixing ratio of raw fiber-3 is increased and when raw fiber-3 alone is used (the ratio of fiber-3 is 100%), the strength retention ratio is drastically reduced. In contrast, when raw fiber-1 which has an island component having a sheath/core structure according to the present invention, was mixed, even if the raw fiber-1/raw fiber-2 weight ratio was changed to 70/30 from 30/70, the strength retention ratio of the non-woven fabric was reduced only slightly. Thus, it was confirmed that the fiber of the present invention is very excellent.

COMPARATIVE EXAMPLE

A composite fiber was spun in the same manner as described in Example 1 except that PET having an IV value of 0.53 (containing 0.5 mole% of Boric acid in order to increase apparent melt viscosity and spinnability) was used as the core component of the island component. The island/sea weight ratio was 57/43 and the core/sea ratio in the island component was 25/72. Then, the spun yarn was drawn at a draw ratio of 2.98 according to the drawing method described in the Example 2. The strength of the island component of the obtained drawn yarn was below 3.0 g/d and, thus, was poor in strength. The IV value of the core component after removal of the sheath was about 0.50.

EXAMPLE 5

A three-component fiber having a sectional structure shown in FIG. 2 was formed into a felt. The composition and physical properties are as follows.

Component A: 32 parts by weight of PET

Component B: 25 parts by weight of PET containing 5-SS units in an amount of 2.43 mole % based on the total acid component Component C: 43 parts by weight of polystyrene copolymerized with 22 wt.% of 2-ethylhexylacrylate Fiber length: about 51 mm.

Fineness of fiber: 3.8 denier

Crimp number: about 16 crimps/25.4 mm.

Strength of composite fiber AB: about 4.5 g/d

Formation of felt: needle punching method

Base weight of felt: 650 g/m$^2$

The felt was immersed in boiling water (85° C.), squeezed by a mangle and then dried.

A solution containing 13.5% by weight of partially saponified PVA was applied to the felt in an amount of about 26% by weight based on composite fiber AB. Then, the felt was sufficiently washed with trichloroethylene and a DMF solution containing 13.5% by weight of PU was impregnated and coagulated in warm water. The PVA was removed, and the felt was washed with hot water, dried, sliced into halves and buffed.

The buffed felt was dyed under the following conditions.

Dyeing bath:

3% owf of Aizen Cathilon Blue CD-FBLH (cationic dye)

0.6 g/l of acetic acid 0.45 g/l of sodium acetate 3 g/l of anhydrous Glauber salt Bath ratio: 1:50

Dyeing temperature and time: 120° C. for 60 min.

Washing after dyeing: 2 g/l of Laccol PSK (anionic surface active detergent supplied by Meisei Kasei Co.)., bath ratio of 1:50, treatment temperature of 60° C., treatment time of 20 min., and subsequent hot water washing and water washing.

The dyed felt had a longitudinal tensile strength of 0.0258 Kg/weight (g/m$^2$) cm. of width. For comparison, the above procedures were repeated by using component B alone for the island component. The strength of the fiber was 2.69 g/d and the longitudinal tensile strength of the dyed felt was 0.0138 Kg/weight (g/m$^2$)cm of width. Thus, it was found that the comparative product was inferior in physical properties and the product according to the present invention was excellent in physical properties.

The product of the present invention had much greater brilliance than a product prepared using PET alone as the fiber component. The product of the present invention had a softer touch and a better hand and was dyed brilliantly in a blue color. The color depth of the dyed product of the present invention was much greater than the depth of the dyed product prepared in the same manner except for dyeing with disperse dye using the component PET alone.

EXAMPLE 6

Raw felts, which were obtained as in Example 2, were dyed under the following dyeing conditions 1, 2 or 3.

Dyeing condition 1

Dyeing bath:

15% owf of cationic dye (Estrol Black BL supplied by Sumitomo Kagaku Co. Ltd), 0.6 g/l of acetic acid (90%), 0.15 g/l of sodium acetate, 3 g/l of anhydrous Glauber salt.

Bath ratio: 1:50

Dyeing temperature: 120° C.

Dyeing time: 60 min.

Washing after dyeing: 2g/l of Laccol PSK, treatment temperature of 60° C., treatment time of 20 min.

Dyeing condition 2

Dyeing bath: 15% owf of cationic dye (Estrol Black BL), 15% owf of disperse dye (Samaron Black BBL liquid supplied by Hoechst), 0.6 g/l of acetic acid (90%), 0.15 g/l of sodium acetate, 3 g/l of anhydous Glauber salt, 4% owf of surface active agent (Ospin 7000CD supplied by Tokaiseiyu Co).

Bath ratio: 1:50

Dyeing temperature: 120° C.

Dyeing time: 60 min.

Washing after dyeing (a) First washing (reduction clearing): 3.6 g/l of hydrosulfite, 3.6 g/l of caustic soda (48 Baume degree), 1.2 g/l of surface active detergent (Sandet G-29 supplied by Sanyo Kasei Co), treatment temperature of 80° C., for 20 min. (PH-value 13.2).

(b) Second Washing (soaping): 2 g/l Laccol PSK (anionic surface active detergent), at 60° C. for 20 min.

Dyeing condition 3

Dyeing bath: 15% owf of disperse dye (Samaron Black BBL Liquid), 0.45 g/l (acetic acid), 0.6 g/l (sodium acetate), 0.5 g/l (Mignol #4000N dye levelling agent by Ipposya Yushi Co)

Bath ratio: 1:50; temperature and time: 120° C. for 60 min.

Reduction clearing: 3.6 g/l hydrosulfite. 3.6 g/l caustic soda (48 Baume degree), 1.2 g/l (Sandet G-29), at 80° C. for 20 min.

Under each of the dyeing conditions 1,2 and 3, hot water washing and water washing were sufficiently conducted.

Among suede-like artificial leathers prepared by the above dyeing condition 3, less substantial difference in the strength was observed. These products were compared with each other with respect to the color depth and brilliance. The obtained results are shown in Table 1.

TABLE 1

| Dyeing condition | Color Brightness | depth Visual judgement | Brilliance | Overall evaluation |
|---|---|---|---|---|
| 1 | 14.1 | deep slightly light | very brilliant | good |
| 2 | 12.7 | very deep | brilliant | good |
| 3 | 15.0 | slightly | not brilliant | poor |

TABLE 1-continued

| Dyeing condition | Color Brightness | depth Visual judgement | Brilliance | Overall evaluation |
|---|---|---|---|---|
| | | light | | |

It was found that the suede-like artificial leather obtained by using a cationic dye alone or in combination with a disperse dye according to the present invention was excellent in hue.

What is claimed is:

1. A bundle which is substantially composed of a polyester type sheath-core ultrafine composite fiber wherein (a) the fineness is 0.5 to 0.0001 denier, (b) the core component is located substantially at the center of the sheath component, (c) the core component is substantially composed of a polyester selected from the group consisting of polyethylene terephthalate (referred to as PET hereinafter) having an IV value of 0.75 to 1.2 and polybutylene terephthalate (referred to as PBT hereinafter) having an IV value of 0.85 to 2.5 and the sheath component is substantially composed of a polyester copolymerized with a sulfoisophthalate selected from the group consisting of 5-sodium sulfoisophthalate, 5-lithium sulfoisophthalate and 5-potassium sulfoisophthalate (referred to as 5-SS hereinafter), (d) the core/sheath weight ratio is in the range of from 10/90 to 70/30 and the thickness of the sheath is 0.04 to 2 microns, and (e) the 5-sulfoisophthalate component is copolymerized in an amount of 1.5 to 8 mole % based on the total acid components.

2. A three-component type composite fiber which is substantially composed of a plurality of two-component ultrafine composite fibers united in a bundle by interposing a third component, said two component ultrafine composite fiber being a polyester type sheath-core ultrafine composite fiber wherein (a) the fineness is 0.5 to 0.0001 denier (b) the core component is located substantially at the center of the sheath component, (c) the core component is substantially composed of a polyester selected from the group consisting of polyethylene terephthalate having an intrinsic viscosity of 0.75 to 1.2 and polybutylene terephthalate having an intrinsic viscosity of 0.85 to 2.5 and the sheath component is substantially composed of a polyester copolymerized with a sulfoisophthalate selected from the group consisting of 5-sodium sulfoisophthalate, 5-lithium sulfoisophthalate, and 5-potassium sulfoisophthalate, (d) the core/sheath weight ratio is in the range of from 10/90 to 70/30 and the thickness of the sheath is 0.04 to 2 microns, and (e) the sulfoisophthalate component is copolymerized in an amount of 1.5 to 8 mole % based on the total acid components.

3. An ultrafine composite fiber as claimed in claim 1, wherein the 5-SS component is copolymerized in an amount of 2 to 2.8 mole % based on the total acid component, the core/sheath weight ratio is in the range of from 20/80 to 55/45 and the strength is at least 3.8 g/d.

4. A composite fiber as claimed in claim 1, wherein said polyester is one prepared by melt polymerization and subsequent solid phase polymerization.

* * * * *